US005535829A

United States Patent [19]

Fujiki

[11] Patent Number: 5,535,829

[45] Date of Patent: Jul. 16, 1996

[54] REPEATING INJECTOR FOR FIRE EXTINGUISHING GAS

[75] Inventor: Masaru Fujiki, Tokyo, Japan

[73] Assignee: Glory Kiki Co., Ltd., Himeji, Japan

[21] Appl. No.: 271,913

[22] Filed: Jul. 8, 1994

[30] Foreign Application Priority Data

Jul. 23, 1993 [JP] Japan ..... 5-202655

[51] Int. Cl.[6] ..... A62C 17/00

[52] U.S. Cl. ..... 169/76; 169/88; 222/79; 124/52; 124/55

[58] Field of Search ..... 169/52, 71, 76, 169/88; 124/55, 52, 53; 222/79, 81

[56] References Cited

U.S. PATENT DOCUMENTS

| | | | |
|---|---|---|---|
| 1,065,356 | 6/1913 | Grünwald | 169/76 |
| 1,634,976 | 7/1927 | Burke, Jr. . | |
| 1,988,637 | 1/1935 | Tinkham | 169/88 |
| 2,533,685 | 12/1950 | Nurkiewicz | 169/88 |
| 3,005,495 | 10/1961 | Herberg | 169/88 |
| 3,417,719 | 12/1968 | Nittenson . | |

FOREIGN PATENT DOCUMENTS

| | | | |
|---|---|---|---|
| 0451421 | 11/1991 | European Pat. Off. . | |
| 304295 | 11/1920 | Germany . | |
| 575063 | 3/1930 | Germany | 169/76 |
| 9000680 | 7/1991 | Germany . | |
| 2-124180 | 5/1990 | Japan . | |
| 2-121680 | 5/1990 | Japan . | |

OTHER PUBLICATIONS

*Design in Action*; Machine Design; vol. 38; No. 4; p. 42; Feb. 17, 1966.

*Primary Examiner*—Gary C. Hoge
*Attorney, Agent, or Firm*—Browdy and Neimark

[57] ABSTRACT

In order to carry out a fire extinguishing operation by ejecting a fire extinguishing gas having cooling and oxygen deficiency functions and a high fire extinguishing capacity from a plurality of cylinders in succession, a repeating injector is provided with an ejection mechanism which has a magazine containing a plurality of cylinders filled with such a fire extinguishing gas and detachably fixed to a receiver barrel constituting an injector body, and which is adapted to break a seal member on a head portion of each of the cylinders by a triggering operation and eject the fire extinguishing gas, and a cylinder renewing mechanism for discharging a cylinder, which has been subjected to the ejection of the fire extinguishing gas and become empty, by knob-pulling operation, and renewing the cylinder successively. An emptied cylinder is discharged by pulling a knob, and the cylinders in the magazine are sent sequentially to the interior of an extractor in the receiver barrel, the seal member on the head portion of the cylinder in the extractor being broken by a firing pin by a triggering operation, whereby the fire extinguishing gas is ejected from the cylinder.

3 Claims, 7 Drawing Sheets

REPEATING INJECTOR FOR FIRE EXTINGUISHING GAS

BACKGROUND OF THE INVENTION

1. Field of the Invention

This invention relates to a repeating injector for a fire extinguishing gas.

2. Description of the Prior Art

Various types of fire extinguishers have heretofore been produced. One known example of the fire extinguisher is a gas fire extinguisher which uses a cylinder filled with a fire extinguishing gas, such as carbon dioxide in a liquefied state, and which is adapted to eject the gas as a fire extinguishing agent, for example, by manually breaking a seal member of this cylinder. The known fire extinguishers also include a fire extinguisher adapted to eject a powdered or water soluble fire extinguishing agent with a gas pressure. However, among these conventional fire extinguishers, a gas fire extinguisher is not speedily operated by hand, so that an efficient fire extinguishing action using the same cannot be made. When a fire extinguisher adapted to eject a powdered or water soluble fire extinguishing agent is used practically, the machines, instruments, clothes and documents installed, stored and placed in a room are damaged greatly due to the deposition of the fire extinguishing agent thereon during a fire extinguishing operation. It is also possible to use a fire extinguisher having a cylinder filled with a fire extinguishing gas under a high pressure, sealed at a head portion thereof with a seal member, and adapted to eject the fire extinguishing gas when the seal member at the head portion of the cylinder is broken forcibly by a manual operation. However, even in the case of this fire extinguisher in which only one cylinder filled with a fire extinguishing gas is installed, it is necessary to remove a cylinder which has become empty, and install a new cylinder filled with a fire extinguishing gas, by manual operations each time the ejection of the fire extinguishing gas is completed. Namely, since such a cylinder renewing operation takes much time, a fire extinguishing action cannot be carried out continuously with a high efficiency when a fire extinguishing purpose cannot be achieved with only one cylinder.

OBJECTS AND SUMMARY OF THE INVENTION

An object of the present invention is to provide a repeating injector for a fire extinguishing gas which has a plurality of cylinders filled with a fire extinguishing gas of a high fire extinguishing capacity having a cooling function and an oxygen deficiency function, and which is capable of ejecting a fire extinguishing gas continuously in sequence like a machine gun making an efficient fire extinguishing action.

Another object of the present invention is to provide a high-performance repeating injector for a fire extinguishing gas, capable of carrying out a fire extinguishing operation speedily without soiling various kinds of equipment, documents, curios and objects of art in a room.

The repeating injector for a fire extinguishing gas according to the present invention is provided with a plurality of cylinders which are filled with a fire extinguishing gas having a cooling function and an oxygen deficiency function, and which are sealed with a seal member, and it is adapted to eject the fire extinguishing gas repeatedly, the repeating injector including a receiver barrel constituting an injector body, a cylinder storage means which is fixed detachably to the receiver barrel, and which contains a plurality of cylinders each filled with a cooling and oxygen deficiency function-carrying fire extinguishing gas and sealed with a seal member, an ejection means fixed to the receiver barrel and adapted to eject the fire extinguishing gas by breaking the seal member on the head portion of a cylinder by a triggering operation, and a cylinder renewing means fixed to the receiver barrel and adapted to renew the cylinder sequentially by discharging a cylinder, which has been subjected to the ejection of the fire extinguishing gas and become empty, by a knob-pulling operation.

The repeating injector for a fire extinguishing gas according to the present invention is assembled preferably by providing a hollow receiver barrel having openings in upper and lower parts of a substantially longitudinally intermediate portion thereof, a nozzle at a front portion thereof, an insert bore communicating with the nozzle and capable of receiving thereinto a seal member-carrying head portion of a cylinder filled with a cooling and oxygen deficiency function-carrying fire extinguishing gas, a firing pin projecting into the insert bore, and an ejector fixed to the portion of the receiver barrel which is behind the opening in an upper portion thereof, and adapted to fall at its front end portion into the same opening by a resilient force of a spring; inserting into the receiver barrel an extractor having an opening, the size of which is substantially equal to that of the opening in an upper portion of the receiver barrel, in an upper portion thereof, an opening, the size of which is at least substantially equal to that of the opening in an upper portion of the receiver barrel, in a lower portion thereof, an opening, into which the head portion of the cylinder can be inserted, in a front portion thereof, and windows in left and right side walls of a rear portion thereof; inserting a stepped portion-carrying pusher frame into a rear portion of the interior of the receiver barrel so that the pusher frame is urged constantly in the forward direction and adapted to be slidable; fixing a knob to the pusher frame so that the pusher frame can be drawn rearward; connecting a pusher to a front portion of the pusher frame as well as to the extractor; detachably fixing a magazine, which has a spring means in a bottom portion thereof and an opening in an upper portion thereof, to the receiver barrel so that the magazine is aligned with the opening in a lower portion of the receiver barrel and that in a lower portion of the extractor; and fitting in the portion of the receiver barrel which is behind the magazine a grip containing a trigger supported pivotably on pins, urged constantly by springs and engaged at a rear portion thereof with the stepped portion of the pusher frame.

The repeating injector for a fire extinguishing gas according to the present invention is preferably assembled by providing a hollow receiver barrel having openings in upper and lower parts of a substantially longitudinally intermediate portion thereof, a nozzle fixed to a front portion thereof, a receiver fitted firmly in the portion of the receiver barrel which is on the front side of the openings, and having an insert bore shaped so that a seal member-carrying head portion of a cylinder filled with a cooling and oxygen deficiency function-carrying fire extinguishing gas can be inserted thereinto, and a through bore communicating with the insert bore, a slender pipe constituting an ejection bore and connected between the nozzle and receiver, a firing pin joined to the slender pipe so as to project into the insert bore, and an ejector fixed to the portion of the receiver barrel which is behind the opening in an upper portion thereof, and adapted to fall at its front end portion into the same opening by a resilient force of a spring; inserting into the receiver barrel an extractor having an opening, the size of which is substantially equal to that of the opening in an upper portion of the receiver barrel, in an upper portion thereof, an opening, the size of which is at least substantially equal to that of the opening in an upper portion of the receiver barrel, in a lower portion thereof, an opening, into which the head portion of the cylinder can be inserted, in a front portion thereof, and windows in left and right side walls of a rear portion thereof; inserting a stepped portion-carrying pusher frame into a rear portion of the interior of the receiver barrel so that the pusher frame can be slid; fixing a knob to an upper portion of the pusher frame and adapted to be sprung out of a window made in a rear portion of the receiver barrel; fitting a guide pipe firmly in the pusher frame; inserting a recoil spring in the guide pipe; inserting a recoil spring guide pipe through the recoil spring; fixing a rear end portion of the recoil spring guide pipe to a rear bracket fitted firmly in a rear end portion of the receiver barrel; connecting a pusher to a front portion of the pusher frame as well as to the extractor; detachably fixing a magazine, which has a spring means in a bottom portion thereof and an opening in an upper portion thereof, to the receiver barrel so that the magazine is aligned with the opening in a lower portion of the receiver barrel and that in a lower portion of the extractor; and fitting in the portion of the receiver barrel which is behind the magazine a grip containing a trigger supported pivotably on pins, urged constantly by springs and engaged at a rear portion thereof with the stepped portion of the pusher frame, the repeating injector being constructed so that, when the knob is pulled, the pusher frame, pusher and extractor which are operatively connected together are drawn rearward, a rear portion of the trigger engaging the stepped portion of the pusher frame, a cylinder in the magazine being raised by the spring means and placed in the extractor with the ejector put in a lifted state, the trigger being then pulled to cause the pusher to feed the cylinder, which is positioned in front thereof, in the forward direction by an extending force of the pusher frame, the head portion of the cylinder thus fed fitting in the insert bore in the receiver, the seal member on the head portion of the cylinder being broken by the projecting firing pin, so that the cooling and oxygen deficiency function-carrying fire extinguishing gas contained in the cylinder is sent out, the resultant fire extinguishing gas being ejected from the nozzle through the slender pipe.

When, for example, the knob in the repeating injector for a fire extinguishing gas according to the present invention is pulled, the pusher frame, pusher and extractor are moved together in the rearward direction, and a rear end portion of the trigger engages the stepped portion of the pusher frame. At this time, the lower openings in the receiver barrel and extractor and the upper opening in the magazine are aligned with each other. When these openings are aligned with each other, the uppermost cylinder stored in the magazine is raised automatically by an operation of the spring means and placed in the extractor, and a front end portion of the ejector is lifted against the spring as the mentioned portion of the ejector contacts the upper surface of a first cylinder, to become horizontal. A second and subsequent cylinders provided on the bottom of the magazine are constantly urged upward by the spring means, with the second one raised up to the uppermost upper opening position in the magazine. When the trigger is then pulled, the rear end portion of the trigger leaves the stepped portion of the pusher frame, and the recoil spring provided in the guide pipe extends to advance the pusher frame and pusher. The extractor connected to the pusher is also moved forward, and a front end portion of the pusher strikes the rear end portion of the cylinder and drives the cylinder forward while leaving the cylinder held in the extractor. The moment the head portion of the cylinder fits in the insert bore in the receiver, it impinges upon the firing pin to cause the seal member on this head portion to be broken. Consequently, the cooling and oxygen deficiency function-carrying fire extinguishing gas contained in the cylinder is discharged and ejected outside from the front end portion of the nozzle through the slender pipe. When the cylinder is thus struck by the pusher and moved forward, the front end portion of the ejector falls instantly into the upper opening in the receiver barrel owing to an operation of the spring and takes an inclined posture to press the upper surface of a rear portion of the second cylinder which has been raised to the uppermost stage in the magazine, and thereby prevents the second cylinder from being lifted, in cooperation with the first cylinder. In order to use the second cylinder for further continuing the fire extinguishing operation after the ejection of the cooling and oxygen deficiency function-carrying fire extinguishing gas from the first cylinder struck and moved forward by the pusher has been finished, the knob is pulled rearward again. When the knob is thus pulled, the extractor is moved back with the pusher and pusher frame. During this movement of the extractor, the first emptied cylinder fitted in the extractor is lifted at its rear portion in a rear side-raised state by the ejector in an inclined state to spring out from the upper openings in the extractor and receiver barrel, which cylinder is thus discharged to the outside automatically by a traction force transmitted via the extractor. When the knob is pulled, the rear end portion of the trigger engages the stepped portion of the pusher frame. When the first emptied cylinder has been discharged to the outside as mentioned above, the second cylinder positioned in the uppermost stage in the magazine is inserted into the extractor by the push-up force of the spring, and the ejector is lifted at its front end portion by this second cylinder to become horizontal again. The trigger then becomes ready to be pulled.

When the trigger is pulled again, the above-described operations are repeated, and a fire extinguishing action using the second cylinder can be made. In order to further continue the fire extinguishing action after the fire extinguishing gas contained in the second cylinder has finished being ejected, the knob is pulled, and the same operations as described above are repeated.

According to the present invention described above, a plurality of cylinders filled with a cooling and oxygen deficiency function-carrying fire extinguishing gas are placed in the magazine, and the knob is pulled, the trigger being then pulled to drive the cylinder in the uppermost stage forward. Consequently, the seal member on the head portion of this cylinder is broken by the firing pin to eject the fire extinguishing gas. When the ejection of the gas is finished, the knob is pulled to discharge the emptied cylinder to the outside automatically and raise the following cylinder at the same time, whereby the fire extinguishing gas can be ejected in rapid succession. The time for discharging an emptied cylinder and raising the following cylinder at once is very short, so that an efficient fire extinguishing operation can be carried out. The fire extinguishing gas used in the present invention does not cause various kinds of equipment, important articles and documents in a room to be laid under water and soiled.

The above and other objects, features and a advantages of the present invention will become apparent from the following detailed description which is to be read in conjunction with the accompanying drawings.

DESCRIPTION OF THE PREFERRED EMBODIMENT

Figure 1:
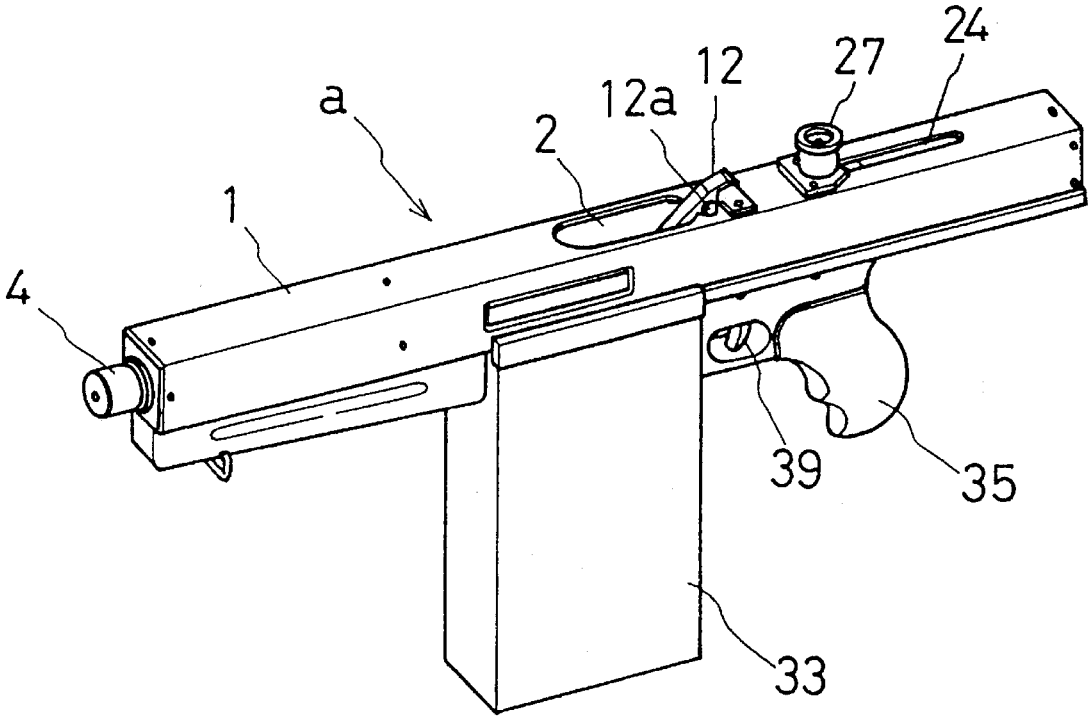
FIG. 1 is a perspective view of an embodiment of the repeating injector for a fire extinguishing gas according to the present invention.

An embodiment of the repeating injector for a fire extinguishing gas according to the present invention will now be described with reference to the drawings.

Referring to the drawings, a reference letter a denotes a repeating injector for a fire extinguishing gas having a cooling function and an oxygen deficiency function, this repeating injector being provided with a hollow receiver barrel 1. This receiver barrel 1 is provided with openings 2, 3 in the upper and lower parts of a substantially intermediate portion thereof, and a nozzle 4 is fixed to a front portion of the receiver barrel 1.

The receiver barrel 1 is provided in the portion of the interior thereof which is on the front side of the openings 2, 3 with a receiver 10: Receiver 10 has an insert bore 8 shaped so that a head portion 7 on a cylinder 5 can be inserted. A through bore 9 communicates with this insert bore 8, and is fitted firmly in the portion of the receiver barrel 1 on the front side of the openings 2,3. A slender pipe 11 constituting an ejection bore is connected between the nozzle 4 and receiver 10.

Cylinder 5 has a seal member 6 and is filled with gas in a liquefied state consisting of carbon dioxide, nitrogen or a mixture thereof as a cooling and oxygen removing function-carrying fire extinguishing gas.

Figure 8:
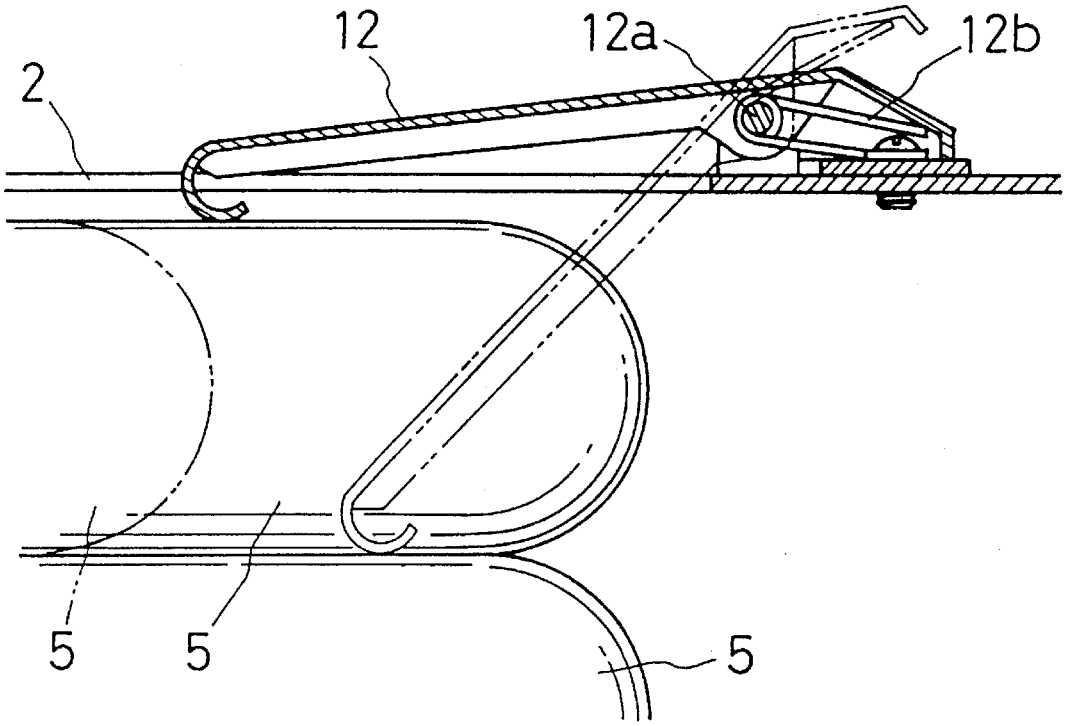
FIG. 8 is an enlarged longitudinal section of an ejector in the embodiment of FIG. 1.

As best shown in FIG. 8, an ejector 12 supported on a pin 12*a* and urged by a spring 12*b* in the direction in which a front end portion of the ejector falls in the opening 2 in the upper portion of the receiver barrel 1 is fixed to the portion of the receiver barrel 1 which is behind the same opening 2. A front bracket 13 is provided in a front end portion, to which the nozzle 4 is fixed, of the receiver barrel 1. An inner bracket 14 is fitted firmly in the portion of the receiver 10 which is provided with the through bore 9, and an O-ring 14*a* is fitted around an outer circumferential surface of the inner bracket 14. The receiver 10 is fixed to the receiver barrel 1 by a set screw 15. One end portion of the slender pipe 11 is fixed in the inner bracket, and a firing pin 17 is connected to the free end of the same end portion so as to project into the insert bore 8.

Figure 2:
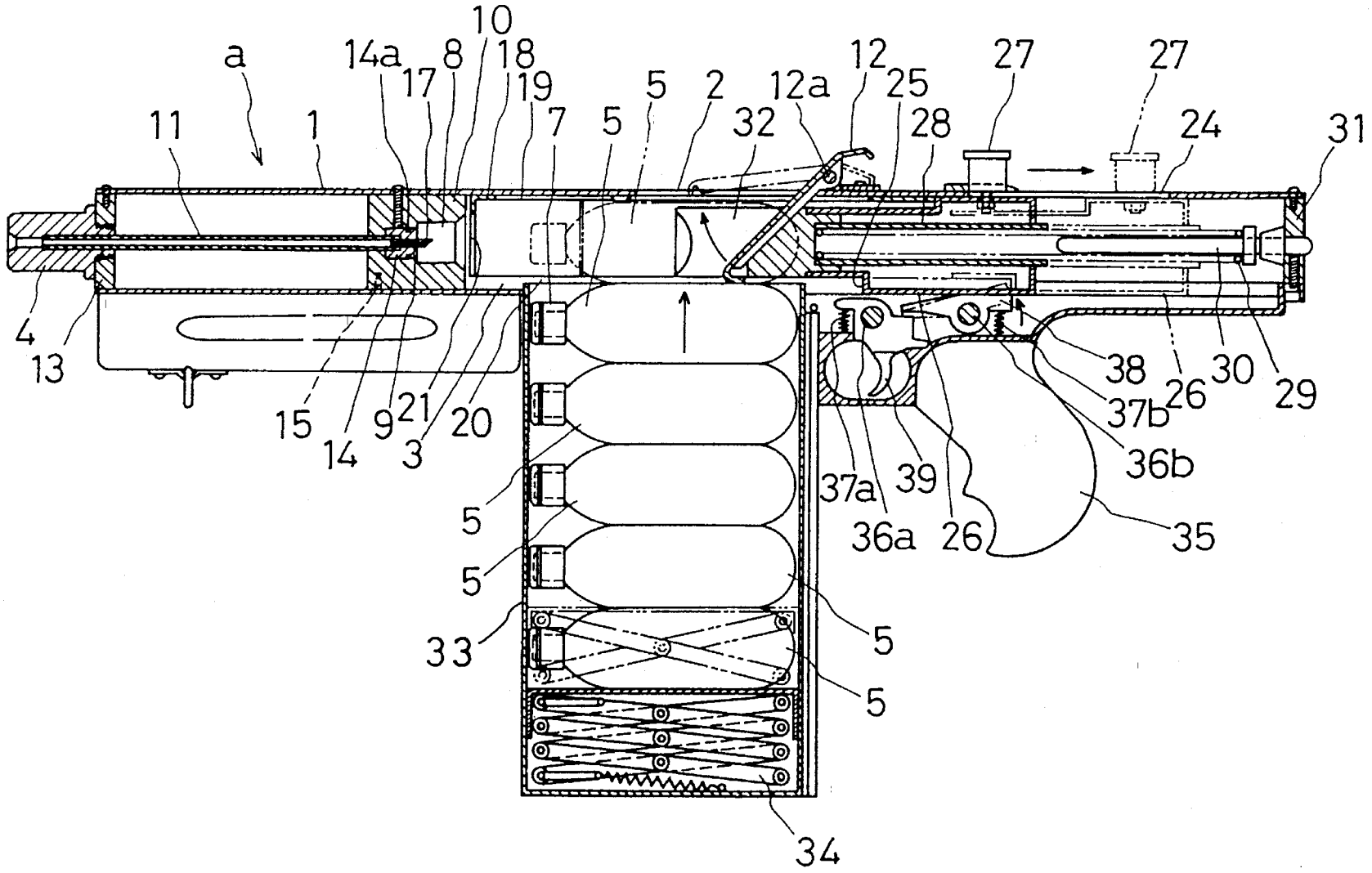
FIG. 2 is a longitudinal section of the embodiment of FIG. 1 in which a first knob-pulling operation has not yet been carried out.
Figure 3:
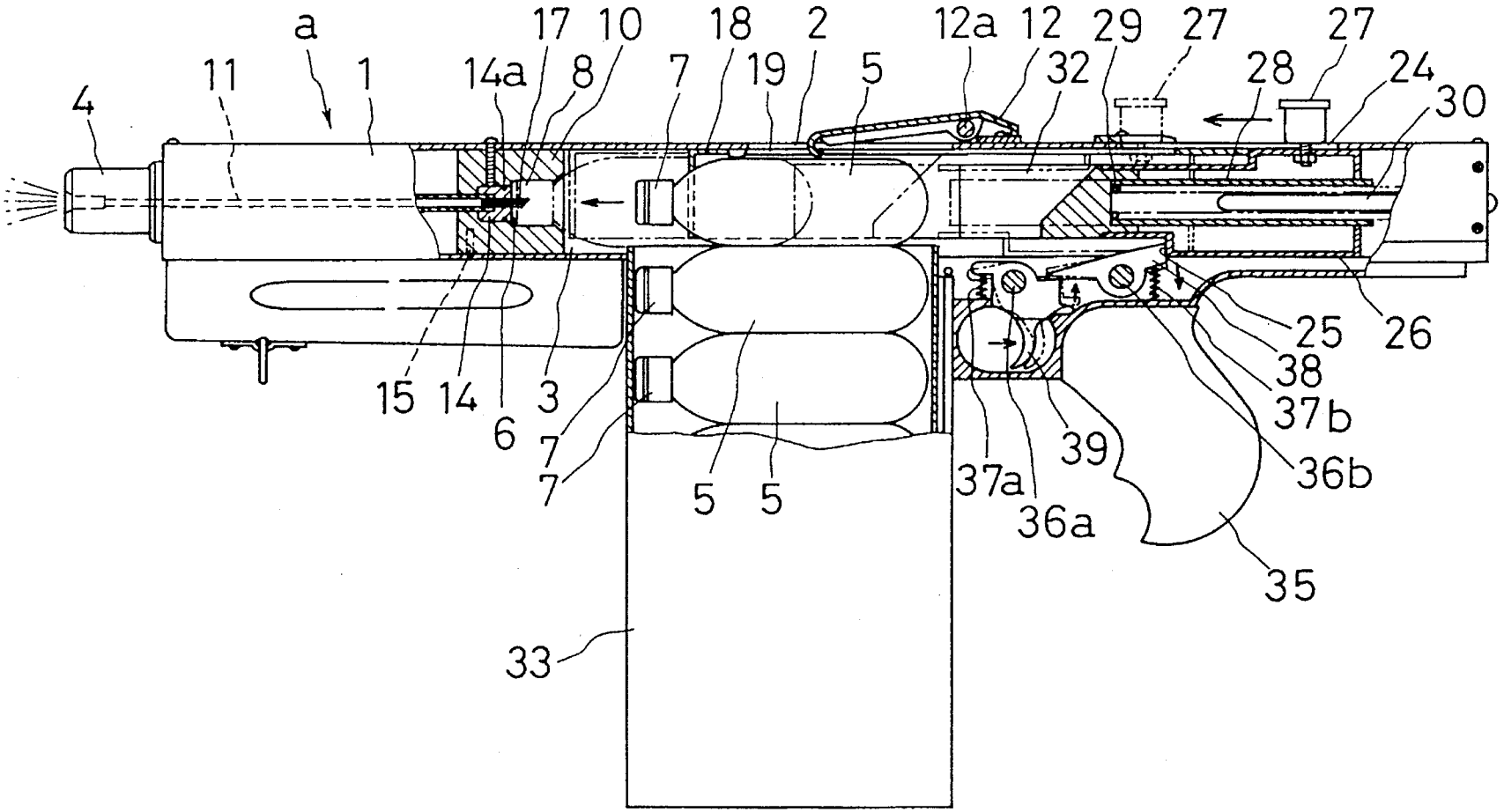
FIG. 3 is a longitudinal section of the embodiment of FIG. 1 in which the knob has been pulled with a trigger not yet pulled.
Figure 5:
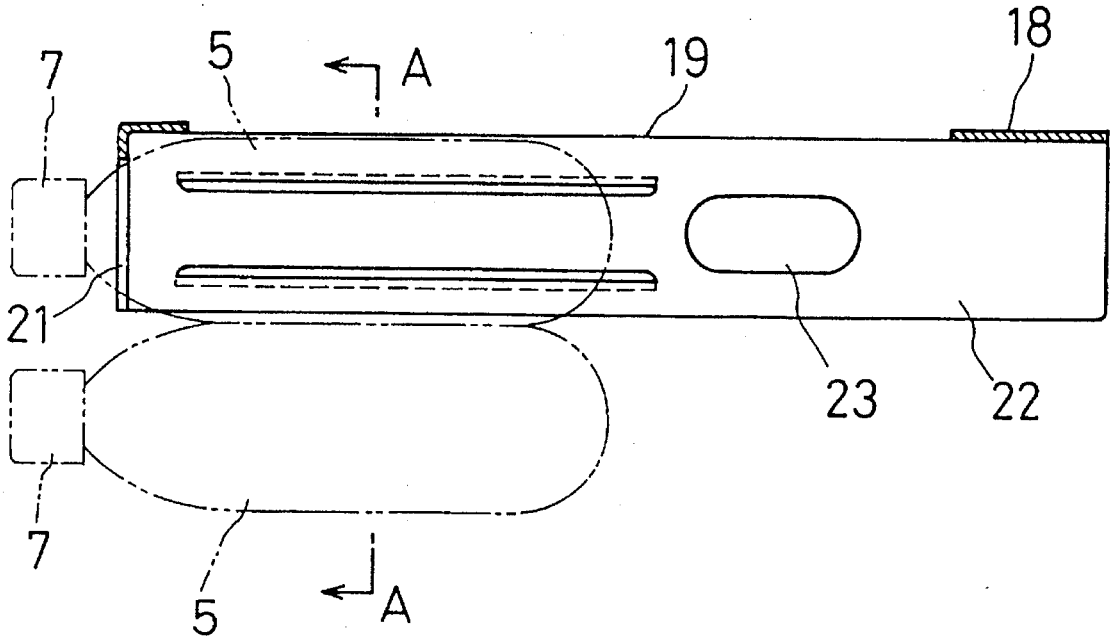
FIG. 5 is a longitudinal section of an extractor in the embodiment of FIG. 1.
Figure 6:
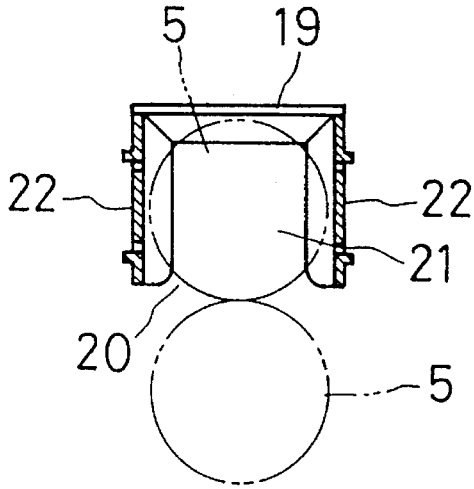
FIG. 6 is a sectional view taken along the line A—A in FIG. 5.

An extractor 18 is fitted in an upper portion of the receiver barrel 1. As best shown in FIGS. 5 and 6, the extractor 18 has an opening 19, the size of which is substantially equal to that of the opening 2 in the upper portion of the receiver barrel 1, in an upper portion thereof, and an opening 20, the size of which is at least substantially equal to that of the opening 2 in the upper portion of the receiver barrel 1, in a lower portion thereof. The extractor 18 is provided in its front portion with an opening 21 into which the head portion 7 of the cylinder 5 can be inserted, and in the rear portions of left and right walls 22 thereof with windows 23. As seen in FIGS. 2 and 3, the receiver barrel 1 is provided in its upper part of a rear portion with a window 24, and in an inner portion thereof with a pusher frame 26 having a stepped portion 25, in such a manner that the pusher frame 26 can be slid. A knob 27 is fixed to an upper portion of the pusher frame 26 so that the knob 27 extends out of the window 24 in the rear portion of the receiver barrel 1. A guide pipe 28 is fitted firmly in the pusher frame 26, and a recoil spring 29 is contained in this guide pipe 28. A recoil spring guide pipe 30 is inserted through the recoil spring 29. The recoil spring guide pipe 30 is fixed at its rear end portion to a rear bracket 31 fitted firmly in a rear end portion of the receiver barrel 1.

A pusher 32 is connected to a front portion of the pusher frame 26. The pusher 32 is connected to the extractor 18 via a pin so that the pusher 32 can be moved relatively thereto by a predetermined distance by utilizing the windows 23 in the rear portion of the left and right walls 22 of the extractor 18.

A reference numeral 33 denotes a magazine. The magazine 33 is provided with a spring means 34 in a bottom portion thereof, and is opened at an upper portion thereof. The magazine 33 is fitted detachably in the opening 3 in the lower portion of the receiver barrel 1 and the lower opening 20 in the extractor 18.

A reference numeral 35 denotes a grip. The grip 35 includes a trigger 39 which is formed so that the trigger is turned via pins 36*a*, 36*b*, pressed constantly by springs 37*a*, 37*b* and engaged at its rear portion 38 with the stepped portion 25 of the pusher frame 26. The grip 35 is fitted in the portion of the receiver barrel 1 which is on the rear side of the magazine 33.

Figure 7:
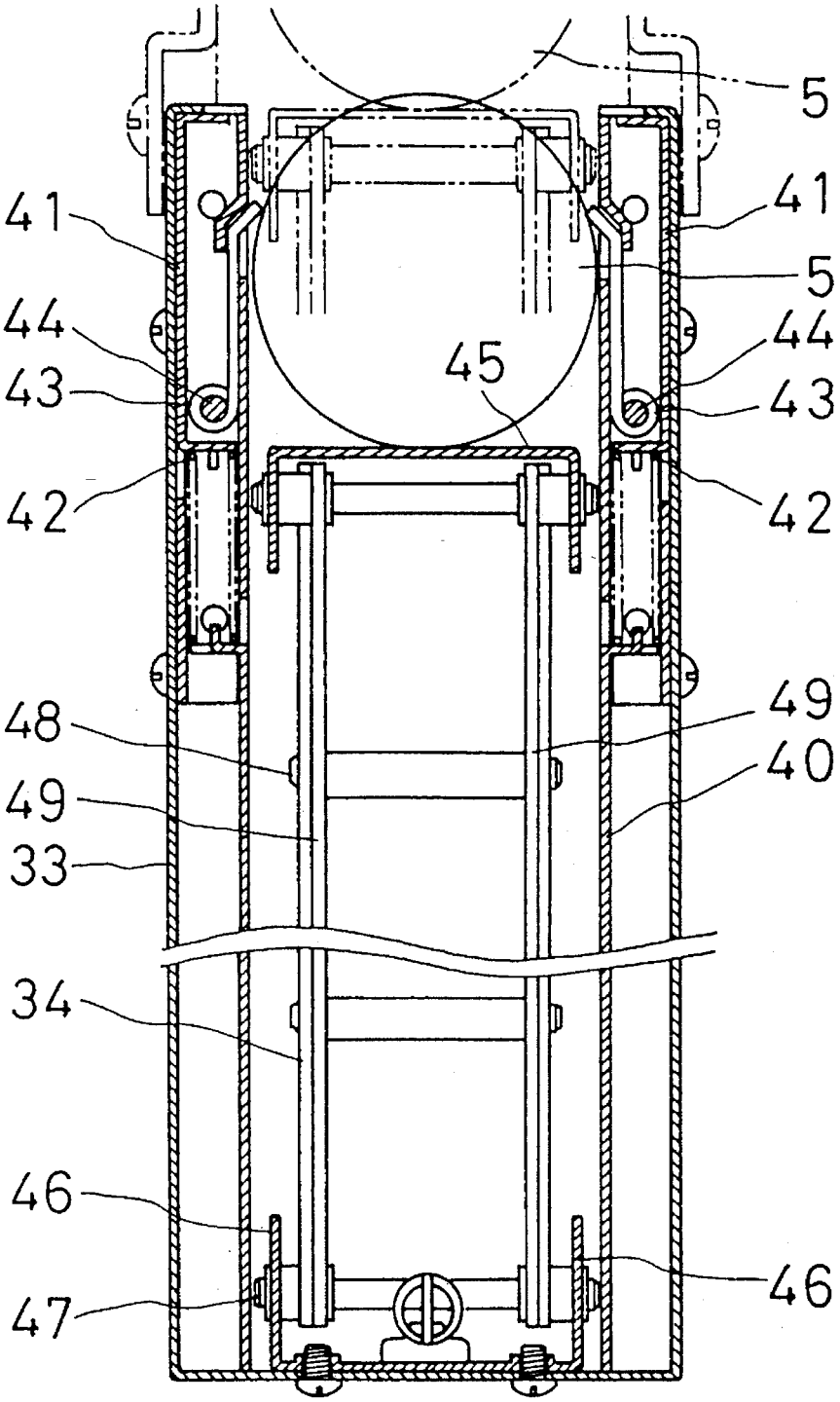
FIG. 7 is an enlarged longitudinal section, which is taken along a plane crossing FIG. 1 at right angles, of a magazine in the embodiment of FIG. 1.

As shown in FIG. 7, an inner mechanism of the magazine 33 consists of left and right inner plates 40 provided in the magazine 33, left and right keys 41 fixed to upper portions of the inner plates 40, left and right springs 42 provided between the keys 41 and inner plates 40, left and right hooks 43 fixed at one end portion of each thereof and extending upright at the other end portion thereof, pins 44 provided on the inner side of the keys 41 and fixing one end portion of the hooks 43, a magazine follow 45 provided so as to cover an upper portion of the spring means 34, a shaft 47 retaining a lower end portion of the spring means 34, brackets 46 for fixing the shaft 47 thereon, and shafts 48 and legs 49 of the spring means 34.

When the knob 27 of the embodiment in the condition shown in FIG. 2 is pulled to a position shown by two-dot chain lines, the pusher frame 26, pusher 32 and extractor 18 are drawn together, and the rear portion of the trigger 39 engages the stepped portion 25 of the pusher frame 26. Consequently, the cylinder 5 in the uppermost stage in the magazine 33 is raised by the spring means 34 and placed in the extractor 18 with the ejector 12 lifted at the same time. When the trigger 39 is then pulled, it comes off the stepped portion 25 of the pusher frame 26, and the pusher 32 is pressed forward by an extending force of the recoil spring 29, the cylinder 5 in the extractor 18 being struck by the pusher 32 thus displaced, and pressed forward. The seal member 6 on the head portion 7 of the cylinder 5 is broken by the firing pin 17 projected into the insert bore 8, and the fire extinguishing gas contained in the cylinder 5 is sent out, the resultant fire extinguishing gas being ejected from the nozzle 4 through the slender pipe 11.

Figure 4:
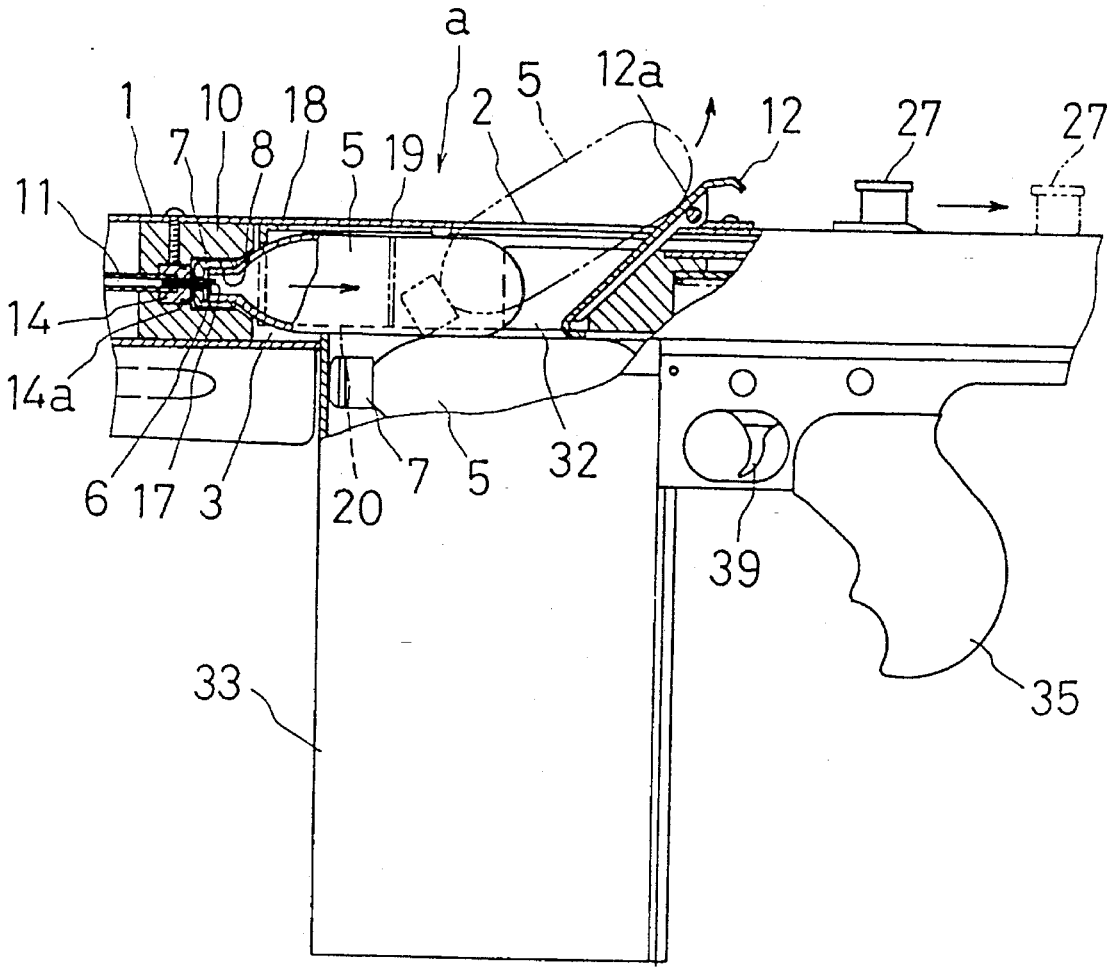
FIG. 4 is a partially cutaway view in longitudinal section of the embodiment of FIG. 1 in which the ejection of a fire extinguishing gas has been finished with a further knob-pulling operation not yet carried out.

When the cylinder 5 is thus struck by the pusher 32 and moved forward, the front end portion of the ejector 12 falls instantly into the upper opening in the receiver barrel 1 owing to an operation of the spring 29 and takes and inclined posture to press the upper surface of a rear portion of the second cylinder 5 which has been raised to the uppermost stage in the magazine, 33, and thereby prevents the second cylinder 5 from being lifted, in cooperation with the first cylinder 5. In order to use the second cylinder 5 for further continuing the fire extinguishing operation after the ejection of the cooling and oxygen deficiency function-carrying fire extinguishing gas from the first cylinder 5 struck and moved forward by the pusher 32 has been finished, the knob 27 is pulled rearward again. When the knob 27 is thus pulled, the extractor 18 is moved back with the pusher 32 and pusher frame 26. As shown in FIG. 4, during this movement of the extractor 18, the first emptied cylinder 5 fitted in the extractor 18 is lifted at its rear portion in a rear side-raised state by the ejector 12 in an inclined state to spring out from the upper openings 19,2 in the extractor 18 and receiver barrel 1, which cylinder 5 is thus discharged to the outside automatically by a traction force transmitted via the extractor 18. When the knob 27 is pulled, the rear end portion of the trigger 39 engages the stepped portion 25 of the pusher frame 26. When the first emptied cylinder 5 has been discharged to the outside as mentioned above, the second cylinder 5 positioned in the uppermost stage in the magazine 33 is inserted into the extractor by the push-up force of the spring 34, and the ejector 12 is lifted at its front end portion by this second cylinder 5 to become horizontal again. The trigger 39 then becomes ready to be pulled.

It should be understood that we intend to cover by the appended claims all modifications falling within the true spirit and scope of our invention.

What is claimed is:

1. A repeating injector for a fire extinguishing gas, comprising: a receiver barrel constituting an injector body, a cylinder storage means which is fixed detachably to said receiver barrel, and which contains a plurality of cylinders each filled with a fire extinguishing gas and sealed with a seal member, an ejection means fixed to said receiver barrel for receiving one of said cylinders and tier ejecting said fire extinguishing gas by breaking said seal member, said ejection means including a trigger for activating said ejection means, and a cylinder renewing means fixed to said receiver barrel for discharging an empty cylinder from said ejection means, and positioning another of said plurality of cylinders in said ejection means, said cylinder renewing means including a knob for activating said cylinder renewing means.

2. A repeating injector comprising:

a receiver barrel which is hollow and has a first opening and a second opening in substantially longitudinally intermediate portions of opposite walls thereof, a nozzle at a front portion thereof, an insert bore communicating with said nozzle which receives thereinto a seal member-carrying head portion of a first cylinder of a plurality of cylinders filled with a fire extinguishing gas, a firing pin projecting into said insert bore, and an ejector pivotally fixed to a portion of said receiver barrel which is behind said first opening, said ejector being biased to extend into said first opening by a resilient force of a spring, an extractor inserted into said receiver barrel having a first opening, the size of which is substantially equal to that of said first opening in said receiver barrel, in a first wall thereof, a second opening, the size of which is at least substantially equal to that of said second opening in said receiver barrel in a second wall thereof which is opposite to said first wall, a third opening into which said head portion of said cylinder can be inserted in a front portion of the extractor, and windows in opposite side walls of a rear portion thereof, a stepped portion-carrying pusher frame slidably engaged in a rear portion of the interior of said receiver barrel and biased constantly in the forward direction, a knob fixed to said pusher frame for drawing said pusher frame rearwardly, a pusher connected to a front portion of said pusher frame as well as to said extractor, a magazine detachably fixed to said receiver barrel, said magazine having a spring means in a bottom portion thereof and an opening in an upper portion thereof, said magazine being aligned with said second opening in said receiver barrel and said second opening in said extractor, and a portion of the receiver barrel which is behind said magazine having a grip containing a trigger supported pivotally on pins, said trigger being urged constantly by springs and engaged at a rear portion thereof with said stepped portion of said pusher frame.

3. A repeating injector for a fire extinguishing gas, comprising:

a receiver barrel which is hollow and has a first opening and second opening in substantially longitudinally intermediate portions of opposite walls thereof, a nozzle fixed to a front portion thereof, a receiver fitted firmly in the portion of said receiver barrel which is on a from side of said first opening and said second opening, said receiver having an insert bore which receives thereinto a seal member-carrying head portion of a first cylinder of a plurality of cylinders filled with a fire extinguishing gas, a through bore communicating with said insert bore, a slender pipe constituting an ejection bore connected between said nozzle and said receiver, a firing pin joined to said slender pipe so as to project into said insert bore, and an ejector pivotally fixed to a portion of said receiver barrel which is behind said first opening, said ejector being biased to extend into said first opening by a resilient force of a spring, an extractor inserted into said receiver barrel having a first opening, the size of which is substantially equal to that of said first opening in said receiver barrel in a first wall thereof, a second opening the size of which is at least substantially equal to that of said second opening in said receiver barrel in a second wall thereof opposite to said first wall, a third opening into which the head portion of the cylinder can be inserted, in a front portion of the extractor, and windows in rear portions of said two opposite walls thereof, a stepped portion-carrying pusher frame engaged in a rear portion of the interior of said receiver barrel so that said pusher frame can be slid, and a knob fixed to an upper portion of said pusher frame and extending out of a window made in a rear portion of said receiver barrel, a guide pipe firmly fitted in said pusher frame, a recoil spring inserted in the guide pipe, a recoil spring guide pipe inserted through said recoil spring, and a rear end portion of said guide pipe fixed to a rear bracket fitted firmly in a rear end portion of said receiver barrel, a pusher connected to a front portion of said pusher frame as well as to said extractor, a magazine detachably fixed to said receiving barrel, said magazine having a spring means in a bottom portion thereof and an opening in an upper portion thereof, said magazine being aligned with said second opening in said receiver barrel and said second opening in said extractor, and a portion of said receiver barrel which is behind said magazine having a grip containing a trigger supported pivotally on pins, said trigger urged constantly by springs and engaged at a rear portion thereof with said stepped portion of said pusher frame, said magazine housing the plurality of cylinders, whereby, when said knob is pulled, said pusher frame, said pusher and said extractor are drawn together in the rearward direction, a rear portion of said trigger engaging said stepped portion of said pusher frame, one of said cylinders in said magazine being raised by said spring means and placed in said extractor, said trigger, when pulled causing said pusher to feed said one of said cylinders, which is positioned in front thereof, in the forward direction by an extending force of said pusher frame, said head portion of said one of said cylinders thus fed, fitting in said insert bore in said receiver, said seal member on said head portion of said one of said cylinders being broken by said projecting firing pin, so that said fire extinguishing gas contained in said one of said cylinders is sent out, the resultant fire extinguishing gas being ejected from said nozzle through said slender pipe and the empty cylinder being expelled from said repeating injector by lifting said ejector from said first opening in said receiver barrel.

* * * * *